United States Patent [19]

Sheppard

[11] Patent Number: 4,664,293

[45] Date of Patent: May 12, 1987

[54] TUBE WINDER

[76] Inventor: William L. Sheppard, 36655 Romulus Rd., Romulus, Mich. 48174

[21] Appl. No.: 707,876

[22] Filed: Mar. 4, 1985

[51] Int. Cl.[4] ..... B65D 35/32

[52] U.S. Cl. ..... 222/99

[58] Field of Search ..... 222/98–100, 222/95, 251, 406, 410, 97

[56] References Cited

U.S. PATENT DOCUMENTS

| | | | |
|---|---|---|---|
| 1,941,631 | 1/1934 | Socoloff et al. | 222/97 |
| 2,035,713 | 3/1936 | McMackin | 222/99 |
| 2,054,990 | 9/1936 | Newton et al. | 222/99 |
| 2,133,754 | 10/1938 | Oscar | 222/99 |
| 2,754,031 | 7/1956 | Ostrov et al. | 222/99 |
| 2,851,194 | 9/1958 | Krystosek | 222/99 |
| 2,862,647 | 12/1958 | Dietz | 222/99 |
| 2,903,162 | 9/1959 | Regan | 222/99 |
| 3,628,696 | 12/1971 | Duiker | 222/99 |

FOREIGN PATENT DOCUMENTS

| | | | |
|---|---|---|---|
| 47447 | 3/1982 | European Pat. Off. | 222/99 |

*Primary Examiner*—Joseph J. Rolla
*Assistant Examiner*—Nils Pedersen
*Attorney, Agent, or Firm*—Harness, Dickey & Pierce

[57] ABSTRACT

There is disclosed a winder for collapsible tube containers having a transversely movable member to prevent unwinding of a partially-wound tube.

1 Claim, 6 Drawing Figures

TUBE WINDER

BACKGROUND AND SUMMARY OF THE INVENTION

This invention relates generally to collapsible tube containers and more particularly to an improved winder for such containers for progressively collapsing the tube to dispense the material contained therein, and which includes means adapted to cooperate with the container to preclude unwinding thereof.

Collapsible tube containers have been in use for many years and traditionally have comprised thin-walled metal structures which when collapsed and/or wound on a dispensing mandrel have no significant tendency to unwind to reassume their original tube-like form. However, with the advent of new low-cost plastics having properties more desirable than metal for such containers, there has been a growing trend for more and more of such containers to be made out of plastic rather than metal. Although this is desirable in many respects, a flexible wall tube container formed out of plastic suffers the disadvantage that it tends to reassume its original shape after being collapsed, or to unwind in a manner analogous to a coil spring. when this occurs, reverse flow towards the closed end of the partially empty tube can occur, which makes it necessary to again squeeze the full length of the tube during a subsequent dispensing operation, as well as a re-gripping of the tube if it is a manual operation. This, of course, makes for very uneven dispensing. Known winders having anti-unwinding capabilities, on the other hand, tend to be relatively complex and difficult to use.

A primary object of the present invention, therefore, resides in the provision of an extremely simple, inexpensive winder for a collapsible wall tube, which overcomes the aforementioned disadvantages of many known devices, and which is very easy to use.

Additional advantages and features of the present invention will become apparent from the subsequent description and the appended claims taken in conjunction with the accompanying drawings.

DESCRIPTION OF THE PREFERRED EMBODIMENTS

Figure 1:
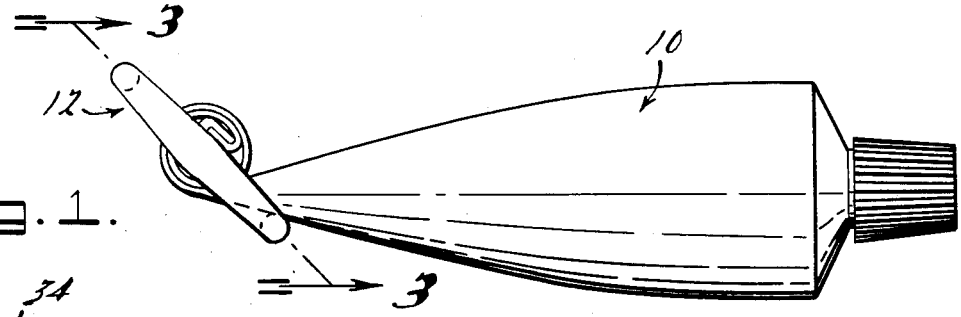
FIG. 1 is a side-elevational view of a collapsible wall tube from which a portion of the contents have already been dispensed by means of a winder embodying the principles of the present invention.
Figure 2:
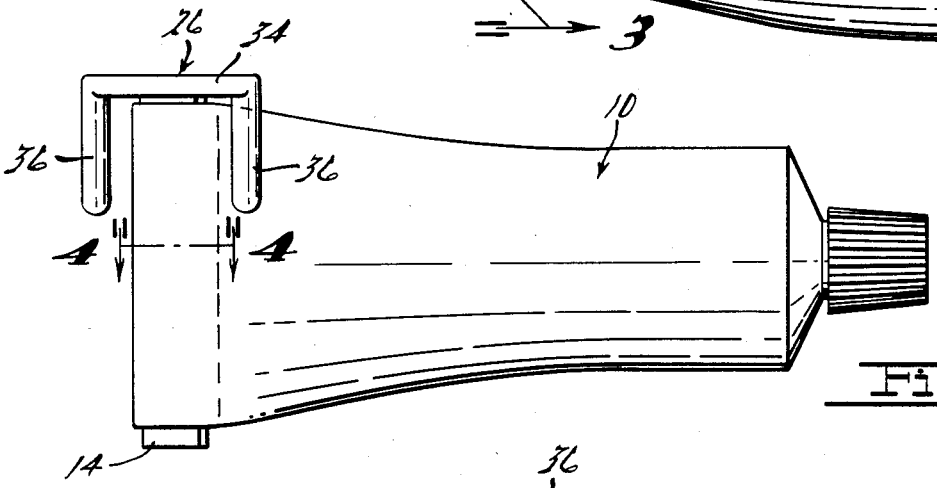
FIG. 2 is a bottom plan view of the assembly of FIG. 1.
Figure 3:
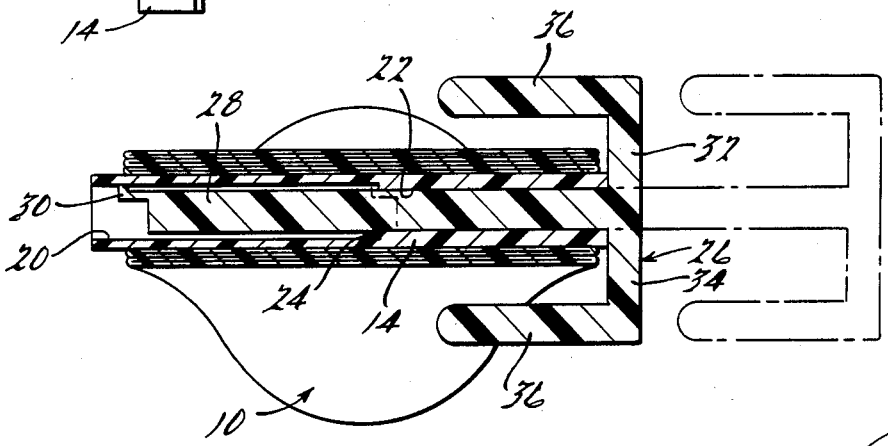
FIG. 3 is a sectional view taken substantially along line 3—3 of FIG. 1 showing in phantom an alternative position of the winder.
Figure 4:
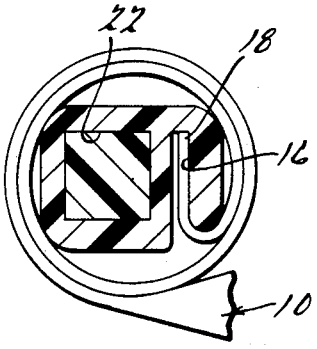
FIG. 4 is a fragmentary cross-sectional view taken substantially along line 4—4 in FIG. 2.

Although the present invention is applicable to many types of collapsible tube containers, it will be described for exemplary purposes in connection with a toothpaste tube.

A first embodiment of a winder embodying the principles of the present invention is illustrated in FIGS. 1 through 4, wherein the toothpaste tube is indicated at 10 and the winder is indicated at 12. The winder comprises a generally elongated hollow mandrel 14 having means defining a slot 16 along one edge thereof adapted to receive the flattened end 18 of a collapsible wall tube 10, the slot having a length at least as great as the maximum flattened width of the tube. Mandrel 14 has a central through-bore comprising a first portion 20 and a smaller second portion 22 defining a shoulder 24 therebetween, both bore portions being generally square in cross-sectional configuration.

Winder 12 also comprises an actuator 26 having an elongated body portion 28, an integral latch portion 30 disposed at one end thereof and an integral handle portion 32 disposed at the opposite end thereof, body portion 28 being generally square in cross-section and being slidably and drivably disposed in second bore portion 22 of winder 14. As can be best visualized from FIG. 3, latch portion 30 comprises an integral hook-like portion which is integral with the end of body portion 28 and which is sufficiently flexible that it deflects downwardly (as shown) when the actuator is inserted into the winder, the fully inserted position being illustrated in solid lines in FIG. 3. The actuator is arranged to be movable between the fully inserted position shown in solid lines to the withdrawn position shown in phantom lines, the latter position being determined by the engagement of latch portion 30 on shoulder 24.

Handle portion 32 comprises a transversely extending arm 34 the center of which is connected to the opposite end of body portion 28 from latch portion 30, each end of arm 34 having an integral leg 36 extending therefrom, each leg 36 being disposed generally parallel and in overlying relationship to body portion 28. Legs 36 are of a sufficient length that when said actuator is fully inserted into said winder, as shown in full lines in FIG. 3, one of the legs will overlie and engage the tube being wound and prevent unwinding thereof.

The device is very simple to use. The flattened end 18 of the toothpaste tube is first inserted into slot 18, the actuator is moved to its withdrawn position shown in phantom lines in FIG. 3 (so that legs 36 will clear the tube), and the winder is then rotated by hand manually holding on to handle portion 32 until the empty portion of the tube is wrapped around mandrel 14. Thereupon the actuator is moved to its fully inserted position in which legs 36 overlie tube 10. This prevents the winder from unwinding more than approximately 180 degrees before one of the legs engages the tube and prevents further relative rotation. When it is desired to dispense additional material, it is simply necessary to pull the actuator to its withdrawn position, and repeat the operation, as can be easily visualized with reference to FIGS. 1 through 4.

Figure 5:
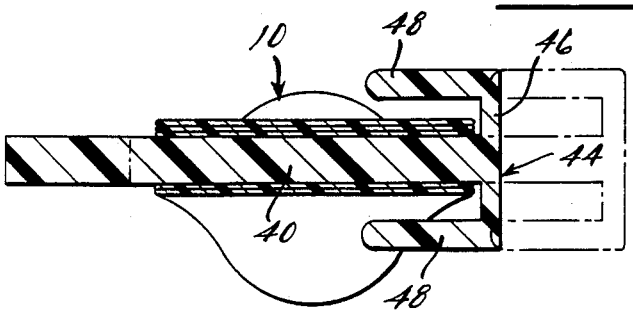
FIG. 5 is a view similar to FIG. 3 but showing a second embodiment of the present invention.
Figure 6:
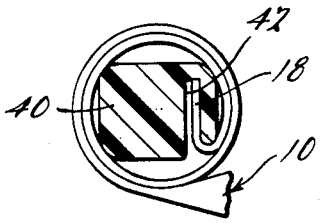
FIG. 6 is a view similar to FIG. 4 illustrating in cross-section the second embodiment of FIG. 5.

In FIGS. 5 and 6 there is illustrated a second embodiment of the present invention. This embodiment is of one-piece construction and therefore even simpler than that of the first embodiment. This embodiment comprises a generally elongated mandrel 40 having means defining a slot 42 along one edge thereof adapted to receive the flattened end 18 of collapsible wall tube 10, the slot having a length at least as great as the maximum flattened width of the tube. An integral handle portion 44 is disposed at one end of mandrel 40 and comprises a transversely extending arm 46 the center of which is connected to the mandrel, each end of arm 46 having a leg 48 extending therefrom, each said leg being disposed generally parallel and in overlying relationship to mandrel 40. Legs 48 are of a sufficient length that when the winder is fully inserted into the partially rolled-up tube, as shown in full lines in FIG. 5, one of the legs will engage the tube being wound and prevent unwinding thereof.

The second embodiment is used in exactly the same manner as that of the first embodiment except that in order to permit legs 48 to clear the tube during winding, it is necessary to move the entire winder to the withdrawn position, such as shown in phantom lines in FIG. 5. This means that it is necessary for the winder to slip with respect to the wound-up tube. Thus, although the second embodiment may in some cases be a little less convenient to use because of need to overcome the friction between the winder and the tube to transversely-withdraw the winder, the winder in other respects provides all the advantages of the first embodiment, but in a simpler, less expensive construction.

All of the parts of both embodiments can be fabricated, as by molding, from any suitable polymeric material, such as polypropylene or the like.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. A winder for a collapsible wall tube, comprising:

a generally elongated hollow mandrel having means defining a slot along one edge thereof adapted to receive the flattened end of a conventional collapsible wall tube, said mandrel having a central through-bore, one end of said through-bore being larger than the other end thereof, thereby defining a shoulder therebetween, both ends of said through-bore being generally square in cross-sectional configuration;

an actuator having an elongated body portion and a handle portion disposed at one end thereof, said body portion being generally square in cross-sectional configuration and being slidably and drivably disposed in said through-bore of said mandrel with said handle portion being disposed outside said through-bore, said handle portion comprising a transversely extending arm connected to said one end of said body portion, one end of said arm having a leg extending therefrom, said leg having a free end portion and being generally straight throughout its length to said free end portion, said leg being disposed generally parallel and in overlying relationship to said body portion, said actuator being slidable in said mandrel transversely of said tube in one direction to permit said leg to clear said tube when said winder is rotated to wind said tube, said leg being of a sufficient length that when said actuator is fully inserted into said mandrel said leg will engage the tube being wound and thereby prevent unwinding thereof; and a latch disposed on the opposite end of said actuator and laterally offset from the longitudinal axis of said body portion, said latch being engageable with said shoulder to limit the distance said actuator can be withdrawn from said through-bore, said distance being just sufficient to permit said leg to clear said tube when said winder is rotated, said latch being sufficiently flexible that it deflects towards the center axis of the actuator when the latter is initially inserted into the said through-bore and returns to its normal condition after such insertion so as to thereafter be engageable with said shoulder.

* * * * *